US012311276B1

(12) United States Patent
Gomez

(10) Patent No.: US 12,311,276 B1
(45) Date of Patent: May 27, 2025

(54) PINBALL MACHINE WITH RETROFITTABLE ACCESSORY

(71) Applicant: STERN PINBALL, INC., Elk Grove Village, IL (US)

(72) Inventor: George A. Gomez, Elk Grove Village, IL (US)

(73) Assignee: Stern Pinball, Inc., Elk Grove Village, IL (US)

( * ) Notice: Subject to any disclaimer, the term of this patent is extended or adjusted under 35 U.S.C. 154(b) by 907 days.

(21) Appl. No.: 17/364,249

(22) Filed: Jun. 30, 2021

Related U.S. Application Data

(63) Continuation-in-part of application No. 17/361,311, filed on Jun. 28, 2021, now Pat. No. 12,121,824.

(60) Provisional application No. 63/046,167, filed on Jun. 30, 2020.

(51) Int. Cl.
*A63F 7/36* (2006.01)
*A63F 7/02* (2006.01)

(52) U.S. Cl.
CPC ..... *A63F 7/027* (2013.01); *A63F 7/36* (2013.01)

(58) Field of Classification Search
CPC ..... A63F 7/025; A63F 7/027
See application file for complete search history.

(56) References Cited

U.S. PATENT DOCUMENTS

| | | | | |
|---|---|---|---|---|
| 5,338,031 | A | 8/1994 | Patla, Sr. et al. | |
| 6,158,737 | A | 12/2000 | Cornell et al. | |
| 6,475,083 | B1 | 11/2002 | Gomez et al. | |
| 11,458,384 | B1 * | 10/2022 | Guidarelli | A63F 7/027 |
| 2007/0026918 | A1 * | 2/2007 | Sheats | G06F 8/65 463/3 |
| 2008/0009331 | A1 * | 1/2008 | Moffett | G07F 17/38 463/3 |
| 2011/0115155 | A1 * | 5/2011 | Frontiero, Jr. | A63F 7/027 463/31 |
| 2013/0113161 | A1 * | 5/2013 | Guarnieri | A63F 7/30 273/121 R |
| 2013/0147111 | A1 * | 6/2013 | Popadiuk | A63F 7/307 273/118 A |
| 2013/0181399 | A1 * | 7/2013 | Stellenberg | A63F 7/2409 273/108 |
| 2013/0228970 | A1 * | 9/2013 | Stellenberg | A63F 7/027 273/121 A |
| 2015/0091250 | A1 * | 4/2015 | Popadiuk, Jr. | A63F 7/025 273/121 R |
| 2017/0001100 | A1 * | 1/2017 | Stellenberg | G07F 17/323 |

* cited by examiner

*Primary Examiner* — Raleigh W Chiu
(74) *Attorney, Agent, or Firm* — Greenberg Traurig, LLP

(57) ABSTRACT

A physical device is provided that is retrofittable to a pinball game. The devices is recognized by the pinball game controller and recognized as being compatible therewith. The device, when pair with the pinball machine causes the pinball machine to control a second gameplay different from a first gameplay controlled when the device is not coupled to the pinball machine. The second gameplay comprises video, audio, and/or scoring events that are only available when the device is connected to the game.

9 Claims, 3 Drawing Sheets

PINBALL MACHINE WITH RETROFITTABLE ACCESSORY

CROSS REFERENCE TO RELATED APPLICATION

This application is a non-provisional application claiming priority from U.S. Provisional Application Ser. No. 63/046,167 filed Jun. 30, 2020, and is a continuation-in-part of U.S. Ser. No. 17/361,311, filed Jun. 28, 2021, each of which is incorporated herein by reference in its entirety.

FIELD OF THE DISCLOSURE

The present disclosure relates generally to amusement devices and more particularly to a pinball machine with a retrofittable accessory.

BACKGROUND OF RELATED ART

Amusement game devices, such as pinball machines, redemption games, etc. of the commercial, e.g., revenue generating, and non-commercial, e.g., home entertainment, type are well known in the art. By way of example, U.S. Pat. Nos. 5,338,031, 6,158,737, and U.S. Published Application No. 2007/0026918 illustrate and describe amusement game devices of the type having a cabinet which houses a playfield.

U.S. Pat. No. 6,475,083 describes a video game system which enables content of a video game dependent upon the type of video game controller coupled to the video game console. In response to recognizing a video game controller as being of a matching type, the video game enables or "unlocks" extra features or "secrets" of the video game which are not otherwise available.

BRIEF DESCRIPTION OF THE DRAWINGS

For a better understanding of the retrofittable accessory disclosed hereinafter reference may be had to the following drawings.

DETAILED DESCRIPTION

The following description of example methods and apparatus is not intended to limit the scope of the description to the precise form or forms detailed herein. Instead the following description is intended to be illustrative so that others may follow its teachings.

With reference to the figures, an amusement game device, in the example form of a pinball machine 10 is now described. It is to be appreciated, however, that this example form for the amusement game device is not intended to be limiting. Rather, those of ordinary skill in the art will appreciated that the retrofittable accessory disclosed hereinafter can be utilized in any type of amusement game device of the commercial and non-commercial type in which it is desired to create an enhanced game experience as desired.

Figure 1:
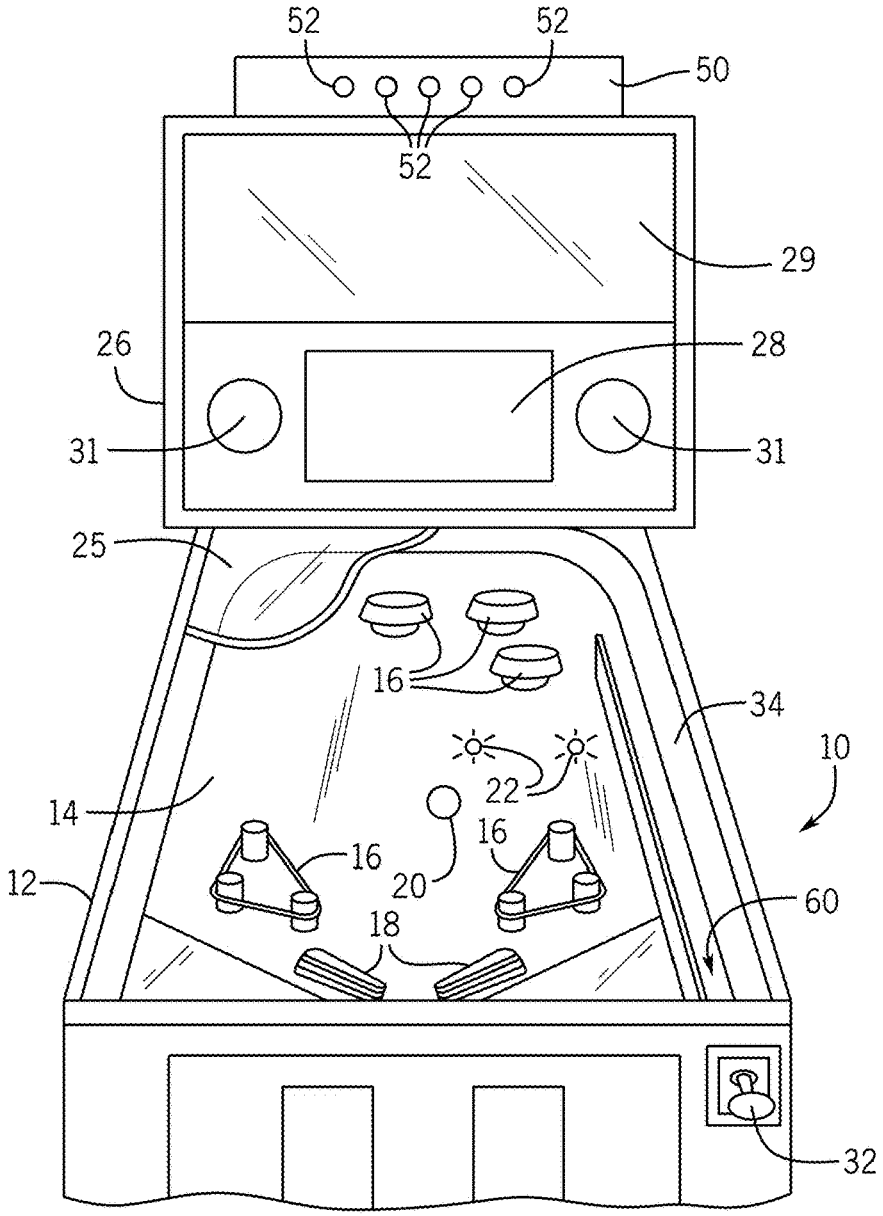
FIG. 1 illustrates an example amusement game device in the form of a pinball machine including an example of the disclosed retrofittable accessory.

The example pinball machine 10 illustrated in FIG. 1 includes a cabinet 12 which houses various apparatus used to define play of a game. Gameplay may be commenced in response to insertion of money, paper or coins referred to collectively as "coins", into a coin accepting device, upon exercising of credits earned, by accepting payment from an account, e.g., via use of a swipe card reading device, a bar code reading device, a QR reading device, a near field communications device, etc., and/or by otherwise making game play active, including free play. Upon activation of the game in this manner, gameplay, in the case of the example pinball machine 10, is defined upon an inclined playfield 14 that supports a number of playfield accessories or devices.

More particularly, in the case of the example pinball machine 10, gameplay is generally defined through the use of a pair of flippers 18 to propel a ball 20 relative to an upperside (e.g., a top surface) of the playfield 14 and input devices/accessories associated with the playfield 14. The playfield 14 is usually inclined from the horizontal, such as for instance between approximately 6.5 to 7.0 degrees, such that the ball tends to eventually roll back down the playfield 14 in the direction of the flippers 18. While not intended to be limiting, the playfield accessories or input devices may include elements such as bumpers 16, ramps, rollover switches 22, targets, and/or other suitable devices.

The playfield 14 may be covered by a transparent or glass sheet cover 25 to permit viewing of the playfield 14. In addition to the foregoing, the playfield 14 typically includes a plunger element 32 which shoots or launches the ball 20 up an alley 34 onto the playfield 14. The playfield 14 may also include lighting elements—which may also be included as a part of the any of the input devices/accessories—and/or other features as desired. Other player-activated input elements, typically in the form of push-buttons (not shown) on the sides (or other location) of the cabinet 12, are usually provided for controlling operation of the flippers 18 or otherwise interacting with gameplay. The pinball machine 10 may also include a backbox 26 which is mounted to overlay a top rear portion of the cabinet 12 and which in this example contains artwork 29, and a game display 28, such as a dot matrix display, CRT, LED or plasma display, or the like. The backbox 26 may also support speakers 31 associated with the game sound system. Within the backbox 26 may be located various ones of the electronic devices/circuits for controlling the operation of the playfield 14, the display 28, general illumination, and the sound system, including speakers 31 and any additional sound system components. Such electronic devices/circuits could also, in whole or in part, be carried within the cabinet 12, or may be external to the cabinet 12 and linked to the pinball machine 10 via any suitable wired or wireless configuration.

The pinball machine 10 also includes a retrofittable accessory, such as a topper 50 than is removably mountable to the pinball machine 10 to affect gameplay (e.g., a first gameplay) as will be described in detail. The topper 50 comprises any number of features, including image, videos, figures, etc., and in this instance, the topper 50 comprises a plurality of lights 52, that when activated during gameplay cause additional gameplay features (e.g., a second gameplay) to be revealed or otherwise accessed that would otherwise be inaccessible without the topper 50.

Figure 2:
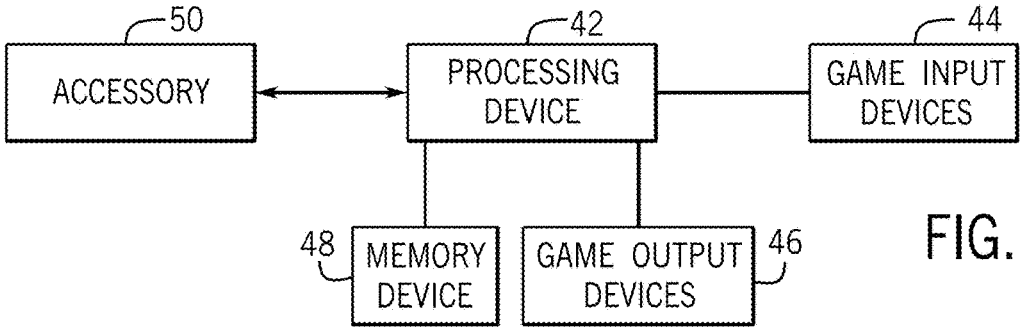
FIG. 2 is an example block diagram of example components of the amusement game device of FIG. 1

Referring to FIG. 2, for controlling the various devices that form the amusement game and gameplay associated therewith, the example pinball machine 10 is provided with a processing device 42 which processing device 42 is, in turn, coupled to game input devices 44, such as switches associated with the cabinet 12, playfield 14, etc., and game output devices 46, such as lights (including lights associated with the playfield 14), bumpers 16, flippers 18, display 28, etc. via one or more buss systems. A memory device 48, such as a RAM, ROM, or the like, stores instructions and data usable by the processing device 42 to control play of the game, the game output devices 46, and the game input devices 44 as necessary based upon signals provided by the game input devices 44. It is to be understood that this illustrated embodiment is not intended to be limiting and that other manners for arranging the devices illustrated in FIG. 2 to provide for control of play of the amusement game can be utilized as needed.

As controlled by the processing device 42, gameplay on the example pinball machine 10 typically has a simple game format that includes a single player attempting to keep the ball 20 active on the playfield 14 for as long as possible, while scoring points for activating and interacting with various game features. As is usual, the example pinball machine 10 allows multiple players to have active games on the pinball machine 10 at the same time, with each player's game being traditionally serial played (turn-based play), such that each player interacts with their own gameplay. For instance, if four active games are allowed at a time, the first player plays until their first ball drains and their turn is over, wherein the second player proceeds to play their first ball with all game features being separate from any influence by the first player. This turn-based gameplay proceeds until all players have their allotted number of balls played.

As shown in FIG. 1, the topper 50 may be optionally mounted to the pinball machine 10 and more precisely, may be operably connected with the processing device 42 to affect, change, or otherwise enhance gameplay. For example, the various game features for the pinball machine 10 such as video, audio presentations, game rules, and configurable events are packaged together at the factory and store in the memory device 48 for execution by the processing device 42. While the various game input devices 44 and game output devices 46 are replaceable for maintenance purposes, those devices do not provide any different features than their original counterparts.

In the present disclosure, various physical devices, such as the topper 50 may operably coupleable to the pinball machine 10 and the processing device 42 or otherwise retrofittable to the pinball machine 10. In this example, devices are designed to be a "plug and play" device, meaning that the device is recognized by the software, hardware, and/or firmware of the pinball machine 10 and recognized as being compatible therewith. In this instance, the devices are an "after purchase" accessories that, when coupled with the original pinball machine 10, enhances and extends the play value of the game. In all cases video, audio and scoring events within the gameplay have additional presentations only available when a specific device is connected to the game. For example the device may provide original gameplay, via software, firmware, and/or hardware updates or enhancements, and/or may "un-lock" new features already stored within the memory device 48 that are not present without the physical device.

Figure 3:
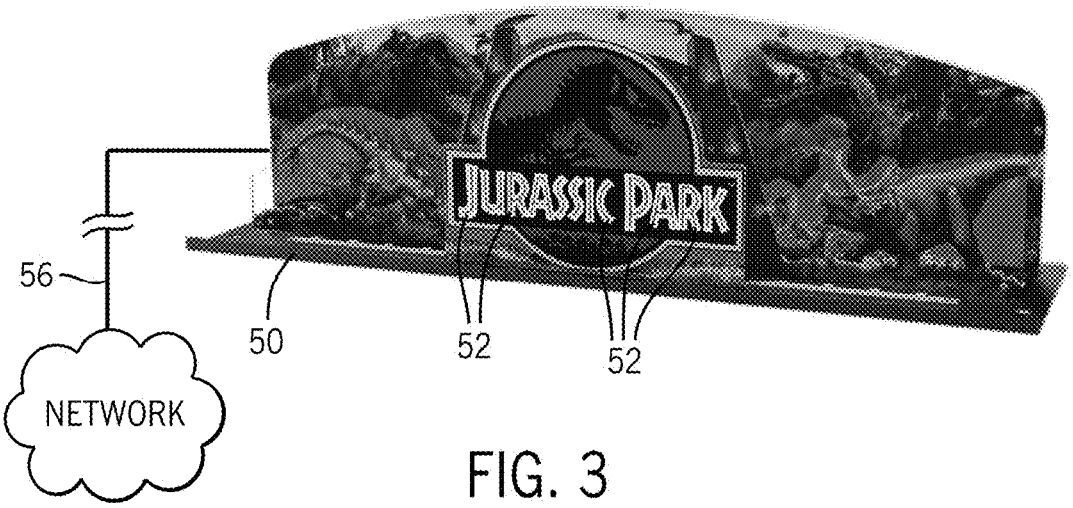
FIG. 3 is a perspective view illustrating an example retrofittable accessory.

In the illustrated example of FIG. 3, the retrofittable physical device is the topper 50 mountable to the pinball machine 10. The example topper 50 includes a series of illuminated icons, such as the lights 52. In this example, the lights 52 correspond to letters, which as illustrated spell out the words "JURASSIC PARK". While only two letters are identified with reference numerals (52) in FIG. 3, any or all of the letters, either alone or in combination, may contain a light as desired.

It will also be appreciated that the topper 50 may be considered a passive device, having physical game features controllable by the processing device 42 when coupled thereto, or may be an active device, including various controllers, node, memories, or other suitable features to all the topper 50 to communicate, interact, and/or otherwise control the elements of the topper 50, such as the lights 52 or even elements of the pinball machine 10 itself. In one instance, completing the illuminated icons on the topper indicate progress and completion of particular gameplay tasks, and show game progression on the topper 50. Progress and completion of the particular gameplay tasks may be limited to each individual player, or as described in detail in U.S. Ser. No. 17/361,311, may be part of a cooperative gameplay between players such that progress of one player is persistently tracked as progress of all players of the pinball machine 10. In still other examples, progress and tracking may be persistent between gameplays (i.e., progress is retained even after gameplay ends) and therefore any player progress during gameplay may be retained for subsequent gameplay (i.e., may be cumulative on the pinball machine 10). Once the player has completed lighting, in this example, the entirety of the logo, a new game mode (e.g., a third gameplay) that is only available with the topper 50 installed is made available to the player on the pinball machine 10, and if appropriate, the new game mode is started. Once complete, the player receives a scoring reward or starts a game mode such as a multi-ball event.

In some examples, the topper 50 and/or the pinball machine 10 may include a network connection 56, such as a suitable wireless or wired network connection to provide software and/or firmware updates related to the enhanced gameplay features as desired.

Figure 4:
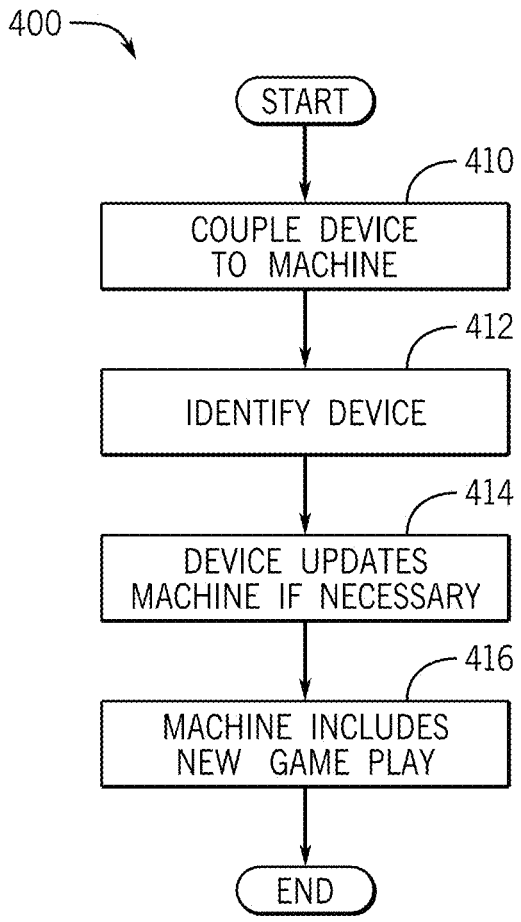
FIG. 4 is a flowchart showing the attachment of the retrofittable device.

An installation process 400 of the topper 50 is shown in FIG. 4. When the topper 50 is installed on the pinball machine 10 and connected to the topper 50 (step 410), the pinball machine 10 will first identify the topper 50 via any suitable identification scheme (step 412). Once identified, the topper 50 may install any software and/or firmware as necessary (step 414) to avail the player a new game mode or rule that requires accomplishing goals within the game's progression that interact with the topper (step 416).

Figure 5:
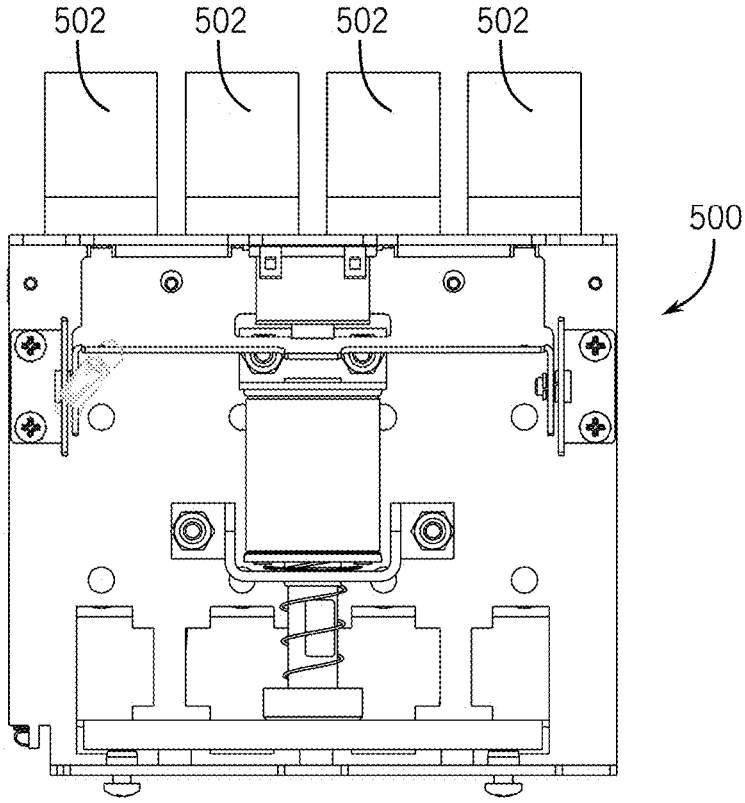
FIG. 5 is a front elevational view of another example retrofittable accessory.

In another example, an illuminated drop target bank 500 (FIG. 5) comprising a plurality of lights 502 mountable above the playfield 14, is designed to replace an array of un-illuminated stationary targets within the original, factory pinball machine 10. Once properly installed and electrically coupled to the pinball machine, the illuminated drop target bank 500 presents a player with a secondary set of goals (i.e., a second gameplay) unavailable on games without the device.

It will be, therefore, understood that an example pinball machine and accessory combination disclosed herein provides for an alternative to traditional factory originated gameplay. While the examples disclosed herein are directed towards a traditional pinball machine arrangement, it will be understood that any suitable amusement device may be utilized. In an illustrated example, a pinball machine topper is illustrated. As is known to one of ordinary skill in the art, the illustrated topper is configured to be coupled to a pinball machine, which in this example is correspondingly themed. In the illustrated example, the letters that make up the logo of the topper are discretely capable of being illuminated. When coupled to the pinball machine, the software, hardware, and/or firmware of the pinball machine recognizes the topper and as a result, as the player completes various gameplay events on the pinball machine, the pinball machine begins illuminating the various letters.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

I claim:

1. A pinball machine comprising:

a plurality of game input devices;

a plurality of game output devices;

a processing device operably coupled to the plurality of game input devices and the plurality of game output devices, the processing device configured to control a first gameplay;

a memory coupled to the processing device and storing instructions that are executable by the processing device; and a game accessory removably coupleable to the processing device, the game accessory containing an identifier that, when received by the processing device, causes the processing device to control a second gameplay different than the first gameplay, wherein the game accessory comprises a plurality of lights, and wherein the processing device receives an indication of a ball interaction with a first game input device of the plurality of game input devices during the second gameplay and the processing device illuminates at least one of the plurality of lights, and when all of the plurality of lights are illuminated, the processing device controls a third gameplay.

2. The pinball machine of claim 1, wherein the game accessory is external mountable to the pinball machine.

3. The pinball machine of claim 1, wherein the game accessory is a pinball game topper.

4. The pinball machine of claim 3, wherein the pinball game topper comprises a topper memory storing instructions thereon that when coupled to the processing device, causes the processing device to control the second gameplay.

5. The pinball machine of claim 1, wherein when the processing device determines that a first player's turn has ended, the processing device keeps at least one of the plurality of lights illuminated.

6. The pinball machine of claim 1, wherein the game accessory comprises a network connection.

7. The pinball machine of claim 1, wherein the second gameplay comprises at least one of video, audio, or scoring events that are not included in the first gameplay.

8. A pinball machine comprising:

a plurality of game input devices;

a plurality of game output devices;

a processing device operably coupled to the plurality of game input devices and the plurality of game output devices, the processing device configured to control a first gameplay;

a memory coupled to the processing device and storing instructions that are executable by the processing device; and a game accessory removably coupleable to the processing device, the game accessory containing an identifier that, when received by the processing device, causes the processing device to control a second gameplay different than the first gameplay, wherein the game accessory comprises an accessory memory storing instructions thereon that when coupled to the processing device, causes the processing device to control the second gameplay.

9. A pinball machine comprising:

a plurality of game input devices;

a plurality of game output devices;

a processing device operably coupled to the plurality of game input devices and the plurality of game output devices, the processing device configured to control a first gameplay;

a memory coupled to the processing device and storing instructions that are executable by the processing device; and a game accessory removably coupleable to the processing device, the game accessory containing an identifier that, when received by the processing device, causes the processing device to control a second gameplay different than the first gameplay, wherein the game accessory comprises a progress indicator during the second gameplay, and wherein the processing device receives an indication of a ball interaction with a first game input device of the plurality of game input devices during the second gameplay and the processing device progresses the progress indicator, and when the progress indicator is complete, the processing device controls a third gameplay.

* * * * *